US005127392A

United States Patent [19]

Mizuno et al.

[11] Patent Number: 5,127,392

[45] Date of Patent: Jul. 7, 1992

[54] INFRARED STOVE APPARATUS

[75] Inventors: Minoru Mizuno; Wakiji Sugimoto, both of Nagoya, Japan

[73] Assignee: Rinnai Kabushiki Kaisha, Japan

[21] Appl. No.: 735,409

[22] Filed: Jul. 24, 1991

[30] Foreign Application Priority Data

Jul. 27, 1990 [JP] Japan ..... 2-19983
Feb. 7, 1991 [JP] Japan ..... 3-16476

[51] Int. Cl.[5] ..... F24C 3/04

[52] U.S. Cl. ..... 126/92 R; 126/92 AC; 110/203; 431/328

[58] Field of Search ..... 126/92 R, 92 AC, 92 A, 126/92 C, 93, 248; 431/326, 328; 110/203

[56] References Cited

U.S. PATENT DOCUMENTS

| | | | |
|---|---|---|---|
| 1,514,332 | 11/1924 | Nieberding | 126/92 AC |
| 1,699,789 | 1/1929 | Hartfield | 126/92 R |
| 1,884,746 | 10/1932 | Kline et al. | 126/92 AC |
| 2,841,133 | 7/1958 | Schwank | 126/92 B |
| 4,466,421 | 8/1984 | Dorsch et al. | 110/203 |
| 4,643,862 | 2/1987 | Callahan | 110/203 |

*Primary Examiner*—James C. Yeung
*Attorney, Agent, or Firm*—Robbins, Dalgarn, Berliner & Carson

[57] ABSTRACT

In an infrared stove apparatus, there is provided a stove body having a radiation window at the front and upper portions of the stove body. A frame is placed within the stove, and one open end of the frame faces to the front portion of the stove body so as to serve as a radiation opening, the other open end of the frame having a porous burner plate through which a mixture of fuel gas and air is to be released. An exhaust opening is provided at the upper lateral side of the frame to pass exhaust gas released through the porous burner plate when the mixture of fuel gas and air is ignited at the time of operation. A metallic net of a suitable mesh screen is provided within the exhaust opening to increase fluid-resistance of the exhaust gas flowing out through the exhaust opening so as to keep a uniform velocity distribution of the exhaust gas while restraining outside air from entering into the frame through the radiation opening leading to the exhaust opening.

13 Claims, 10 Drawing Sheets flow of outside air
flow of exhaust gas temperature distribution of exhaust gas (°C)
emission of nitrogen dioxide
air-permeable member
NO2: 13ppm
not provided
NO2: 8ppm
metallic net (thickness: 0.4mm, 20mesh)
NO2: 6ppm
honeycomb-like ceramic plate
5a
5b
12
12a
41
4
6 flow of outside air
flow of exhaust gas distribution of oxygen concentration (%)
emission of nitrogen dioxide
air-permeable member
NO2: 13 ppm
not provided
NO2 : 8ppm
metallic net (thickness : 0.4mm, 20mesh)
NO2 : 6ppm
honeycomb-like ceramic plate
5a
5b
12
12a
41
4
6
18.6
16.5
16.0
16.0
12.1
16.0
18.0
11.5
9.4
9.5
11.5
8.5
11.6
16.9
11.6
9.1
10.1
9.7
7.3
8.1
15.9

Fig. 5a

| | left | | | | right | average temp. (°C) |
|---|---|---|---|---|---|---|
| entire temperature distribution of exhaust gas | 244 | 477 | 409 | 344 | 292 | 353 |
| | 289 | 508 | 444 | 404 | 314 | 392 |
| | 345 | 576 | 475 | 446 | 328 | 434 |
| | 382 | 650 | 539 | 498 | 368 | 487 |
| | 500 | 708 | 570 | 615 | 433 | 565 |
| | 509 | 764 | 633 | 637 | 469 | 603 |
| | 560 | 832 | 701 | 736 | 616 | 693 |
| | 684 | 830 | 717 | 735 | 639 | 721 |
| air-permeable member | not provided | | | | | |

INFRARED STOVE APPARATUS

BACKGROUND OF THE INVENTION

1. Field of the Invention

The invention relates to an infrared stove apparatus in which a heating is carried out by burning a gas fuel such as natural gas or kerosine on a porous burner plate, and particularly concerns an infrared stove apparatus which is improved to reduce the emission of nitrogen dioxide.

2. Description of Prior Art

Generally an infrared heater device has a casing into which a porous burner plate is enclosed to burn a gas fuel on the plate. The casing has a front opening to which the burner plate is located to face so as to serve as a heat radiation window. The casing further has an upper exhaust opening through which exhaust gas from the burner escapes.

However, a surplus amount of air supplied to the burner plate causes the emission of nitrogen dioxide gas, because nitrogen in the air tends to be oxidized by the high temperature atmosphere around the burner. In order to reduce the amount of the nitrogen dioxide emitted, it has been suggested to place a reducible catalyst within the exhaust opening on the one hand. On the other hand, it has been suggested to provide a baffle plate so as to prevent excessive air from entering the burner plate through the radiation window.

In the former counterpart, the reducible catalyst employed is expensive and easily deteriorates so that it is disadvantageous in saving manufacturing cost.

In the latter counterpart, however, the baffle plate absorbs the heat radiation from the burner and sacrifices radiant heat efficiency.

Therefore, it is an object of this invention to provide an infrared stove apparatus which is capable of reducing the emission of nitrogen dioxide with a relatively simple structure.

SUMMARY OF THE INVENTION

According to the present invention, there is provided an infrared stove apparatus comprising; a stove body having a radiation window at front and upper portions thereof; a frame placed within the stove, one open end of the frame facing to the front portion of the stove body so as to serve as a radiation opening, the other open end of the frame having a porous burner plate through which a mixture of fuel gas and air passes; an exhaust opening provided at an upper side of the frame to pass an exhaust gas released through the porous burner plate when the mixture of fuel gas and air is ignited at the time of operation; and an air-permeable member provided in the proximity of the exhaust opening to increase the fluid-resistance of the exhaust gas flowing out through the exhaust opening so as to substantially maintain a uniform velocity distribution of the exhaust gas while restraining outside air from entering into the frame through the radiation opening leading to the exhaust opening.

The air-permeable member works by increasing the fluid-resistance of the exhaust opening so as to restrain outside air from entering into the frame through the radiation opening and escaping through the exhaust opening, and thus preventing the outside air from being introduced to the burner plate so as to reduce generation of nitrogen dioxide without sacrificing heat radiation from the burner plate.

The air-permeable member works by rectifying the flow of the exhaust gas escaping through the exhaust opening so as to keep a uniform velocity distribution of the exhaust gas. This enables the prevention of high temperature gas from occurring in the exhaust gas, thus avoiding generation of nitrogen dioxide above the exhaust opening.

Various other objects and advantages to be obtained by the present invention will appear in the following description and in the accompanying drawings.

BRIEF DESCRIPTION OF THE DRAWINGS

FIG. 5*a* is a schematic diagram of the entire temperature distribution of exhaust gas escaping through the exhaust opening according to a prior counterpart;

DETAILED DESCRIPTION OF THE PREFERRED EMBODIMENTS

Figure 1:
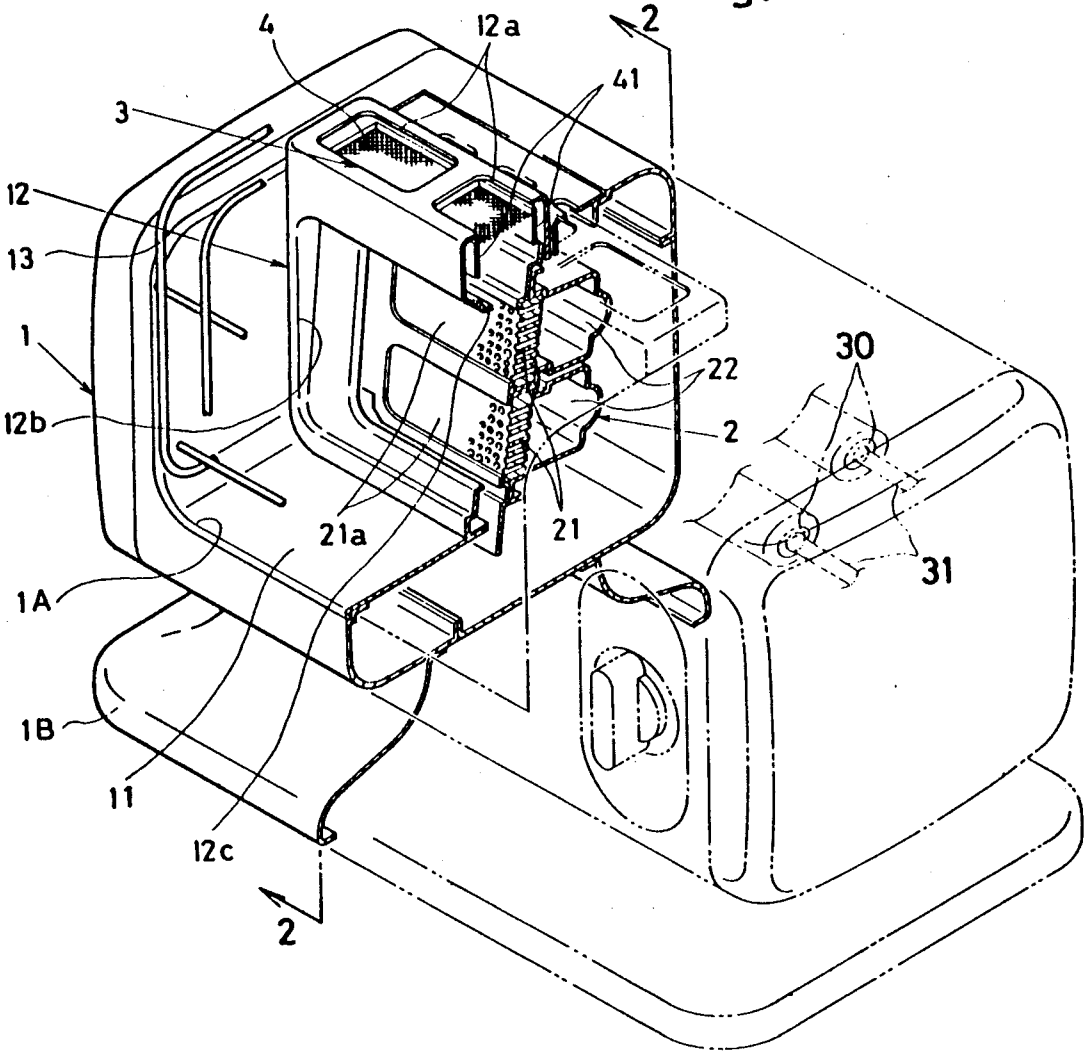
FIG. 1 is a perspective view of an infrared stove apparatus, but partly sectioned according to a first embodiment of the invention.

Referring to FIG. 1 of the drawings which is a first embodiment of the invention, numeral 1 designates a box-like stove body of an infrared stove apparatus within which a gas burner 2 is placed. The stove body 1 is placed on a leg stand 1B, and has an opening extending from a front portion to an upper portion of the stove body 1 to serve as a radiation window 1A. The stove body 1 is covered by a guard 13 at its radiation window 1A. In the stove body 1, a rectangular support frame 12 is generally vertically provided, the front open end 12*b* of which faces the front portion of the stove body 1 while a rear open end of the frame 12 has a burner which has a porous ceramic burner plate 21 on which a number of small fire holes are provided in rows and columns. The burner plate 21 is somewhat slantwisely located at such an angle that the outer surface 21*a* of the burner plate 21 looks up at the radiation window 1A. Attached to the inner surface of the burner plate 21, is an open end of a mixing box 22 into which fuel gas is introduced by a nozzle 31 which is to be mixed with air within an inlet 30. The area between the rear open end of the frame 12 and the outer surface 21*a* of the burner plate defines a combustion region.

The support frame 12 is enamelled, and the upper lateral side of the frame 12 has a blank hole 12*a* to serve as an exhaust opening 3. Between a lower side of the frame 12 and a lower end of the radiation window 1A, a radiation plate 11 is provided. The front open end 12*b* of the support frame 12, which acts as a radiation opening, is inturned to define a barrier flange 12*c* so as to decrease the effective area of the radiation opening 12*b* and which works by regulating outside air entry into the radiation opening 12*b* of the support frame 12.

Within the exhaust opening 3 provided on the upper lateral side of the frame 12, is a metallic net 4 placed by way of a flange mount 41 to act as an air-permeable member. The metallic net 4 is made of a steel alloy (JIS SUS 304) of 20-mesh screen, and 0.4 mm in thickness.

In operation, the mixture of fuel gas and air is released from the fire holes of the burner plate 21, and ignited thereon to be burned. Then, the burned gas finds a way to escape through the exhaust opening 3. During this burning process, an appropriate quantity of heat from the burner plate 21 is radiated through the window 1A to warm a room in which the stove apparatus is installed.

Figures 3A, 3B, 3C:
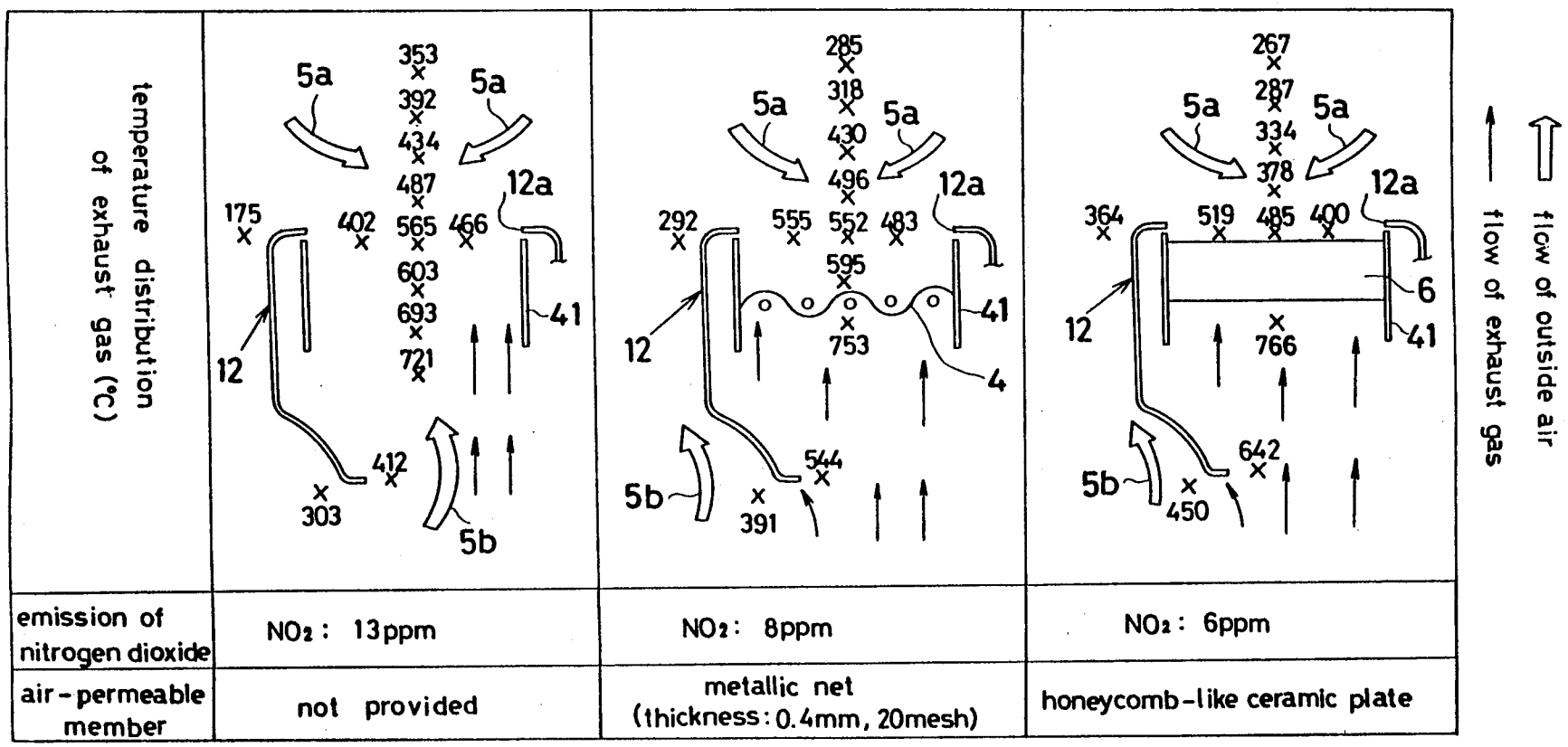
FIG. 3*a* is a schematic diagram of the temperature distribution of exhaust gas escaping through the exhaust opening according to a prior counterpart.
FIG. 3*b* is a schematic diagram of the temperature distribution of exhaust gas when a metallic net is employed.
FIG. 3*c* is a schematic diagram of the temperature distribution of exhaust gas when a honeycomb-like ceramic plate is employed.

When the net 4 is not provided, the concentration of nitrogen dioxide ($NO_2$) is 13 ppm on average as shown in FIG. 3*a*. By providing the net 4, however, it is found that the concentration of nitrogen dioxide reduces to 8 ppm on average as shown in FIG. 3*b*.

When the net 4 is not provided, the exhaust gas tends to locally contain components of high temperature gas (more than 600° C.) above the exhaust opening 3 as shown in FIG. 5*a*. The components of the high temperature gas causes nitrogen oxide in the gas to change to nitrogen dioxide when in contact with outside air 5*a*. In particular, the components of the high temperature gas tend to be partially generated at the left portion in the mixing box 22 because the left portion of the mixing box 22 is located remote from the nozzle 31. On the other hand, the outside air 5*b* tends to enter the frame 12 through the radiation opening 12*b* so that the oxygen concentration around the exhaust opening 3 increases (16~18%) so as to allow contact between the nitrogen oxide and the oxygen as shown in FIG. 4*a*.

Figure 5B:
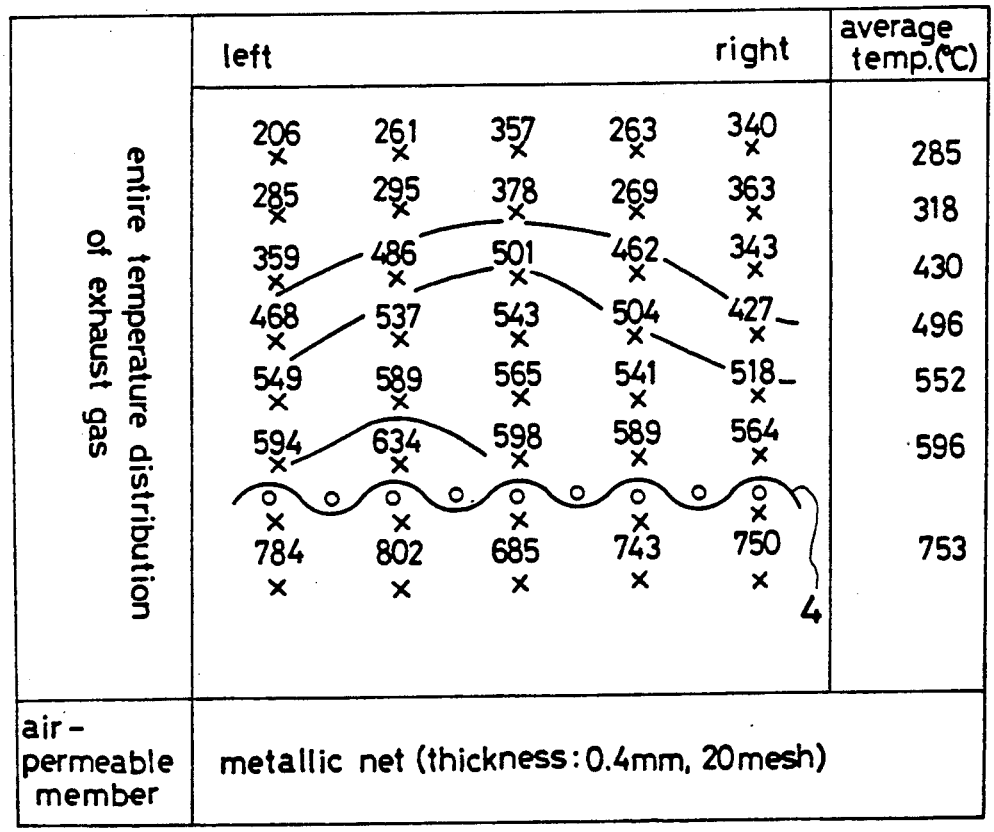
FIG. 5*b* is a schematic diagram of the entire temperature distribution of exhaust gas when a metallic net is employed.

The net 4 works by rectifying the flow of the exhaust gas escaping through the exhaust opening 3 so as to keep a uniform velocity distribution in the exhaust gas as shown in FIG. 5*b*. This enables prevention of high temperature gas from occurring in the exhaust gas, thus avoiding generation of nitrogen dioxide above the exhaust opening 3 even if the exhaust gas comes in contact with outside air 5*a*.

Figures 4A, 4B, 4C:
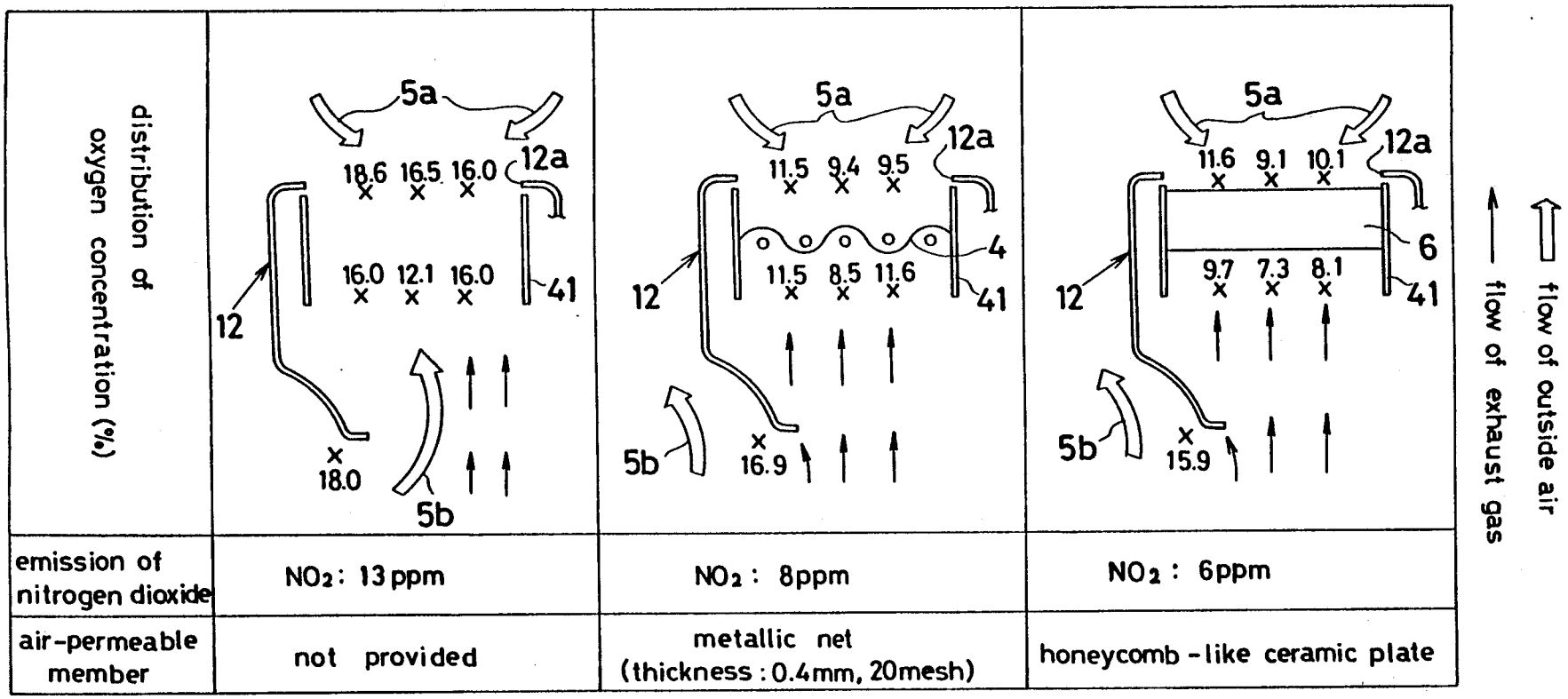
FIG. 4*a* is a schematic diagram of the distribution of oxygen concentration around the exhaust opening according to a prior counterpart.
FIG. 4*b* is a schematic diagram of the distribution of oxygen concentration around the exhaust opening when a metallic net is employed.
FIG. 4*c* is a schematic diagram of the distribution of oxygen concentration around the exhaust opening when a honeycomb-like ceramic plate is employed.

The net 4 works to increase a fluid-resistance of the exhaust opening 3 so as to restrain the outside air 5*b* from entering into the frame 12 through the radiation opening 12*b* to escape through the exhaust opening 3, and thus reducing the oxygen concentration (9.5~11.5%) as shown in FIG. 4*b*, and preventing the outside air 5*b* from being introduced to the burner plate 21 so as to reduce generation of nitrogen dioxide without sacrificing heat radiation from the burner plate 21.

Figure 5C:
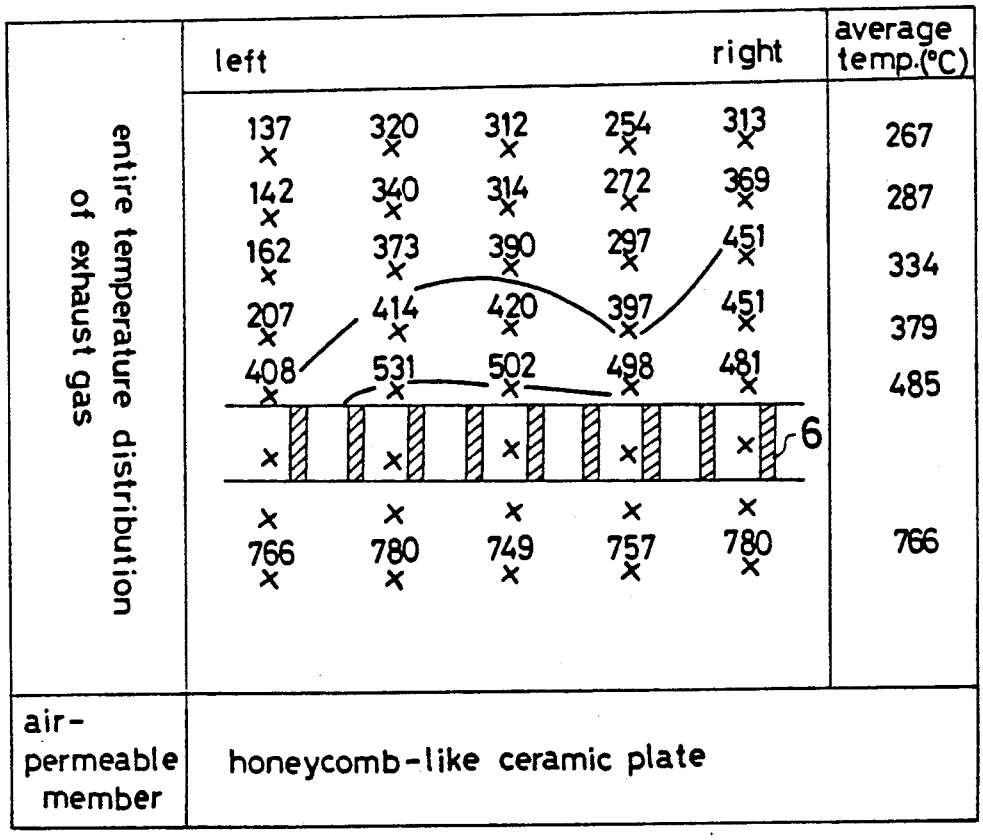
FIG. 5*c* is a schematic diagram of the entire temperature distribution of exhaust gas when a honeycomb-like ceramic plate is employed.

In FIGS. 3*c*, 4*c* and 5*c*, results are shown when a honeycomb-like ceramic plate 6 is employed instead of the metallic net 4. They indicates that the concentration of the nitrogen dioxide is reduced to 6 ppm on average when the honeycomb-like ceramic plate 6 is employed.

Figure 2:
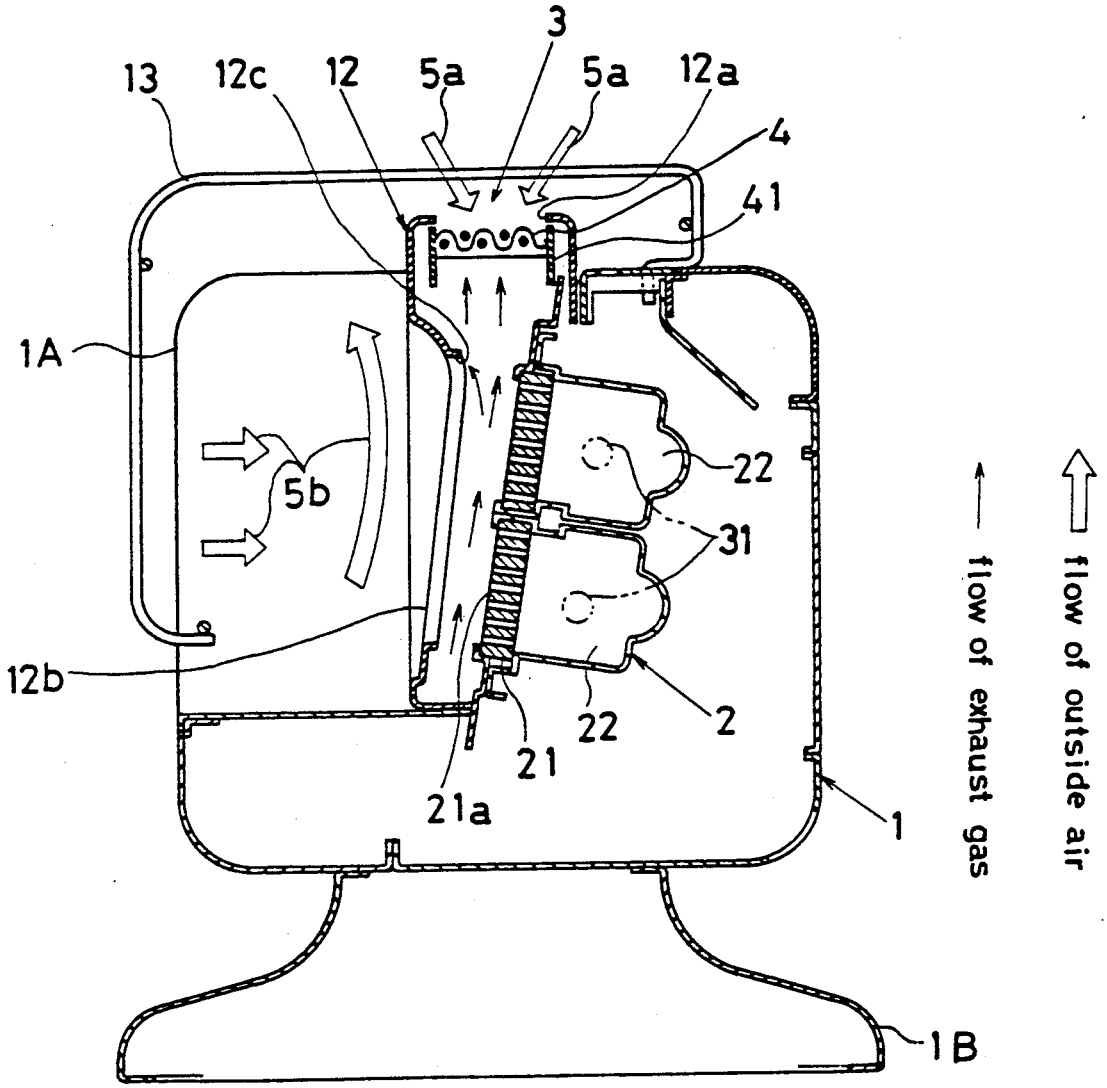
FIG. 2 is a longitudinal cross sectional view taken along the line 2—2 of FIG. 1.
Figure 6:
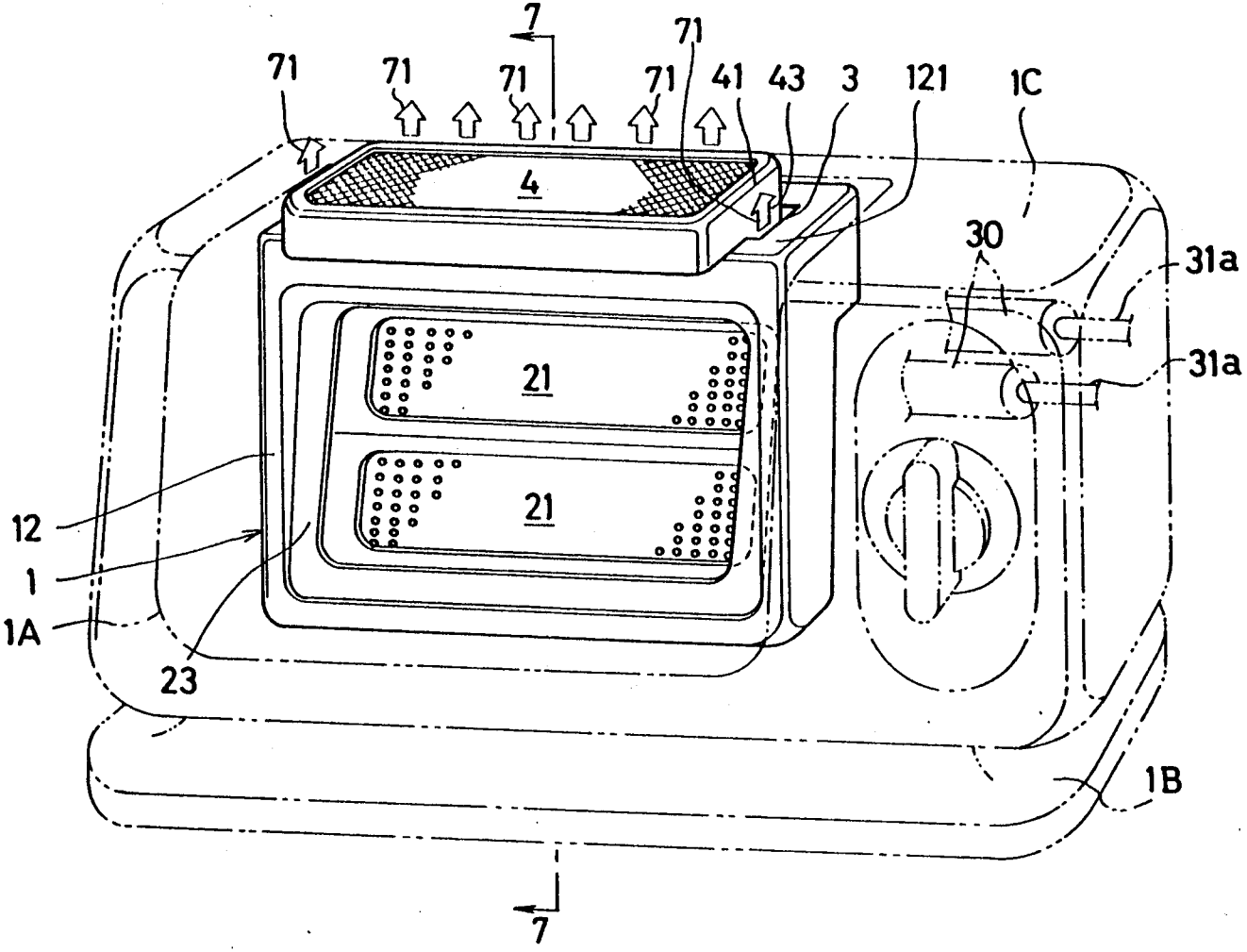
FIG. 6 is a perspective view of an infrared stove apparatus according to a second embodiment of the invention.
Figure 7:
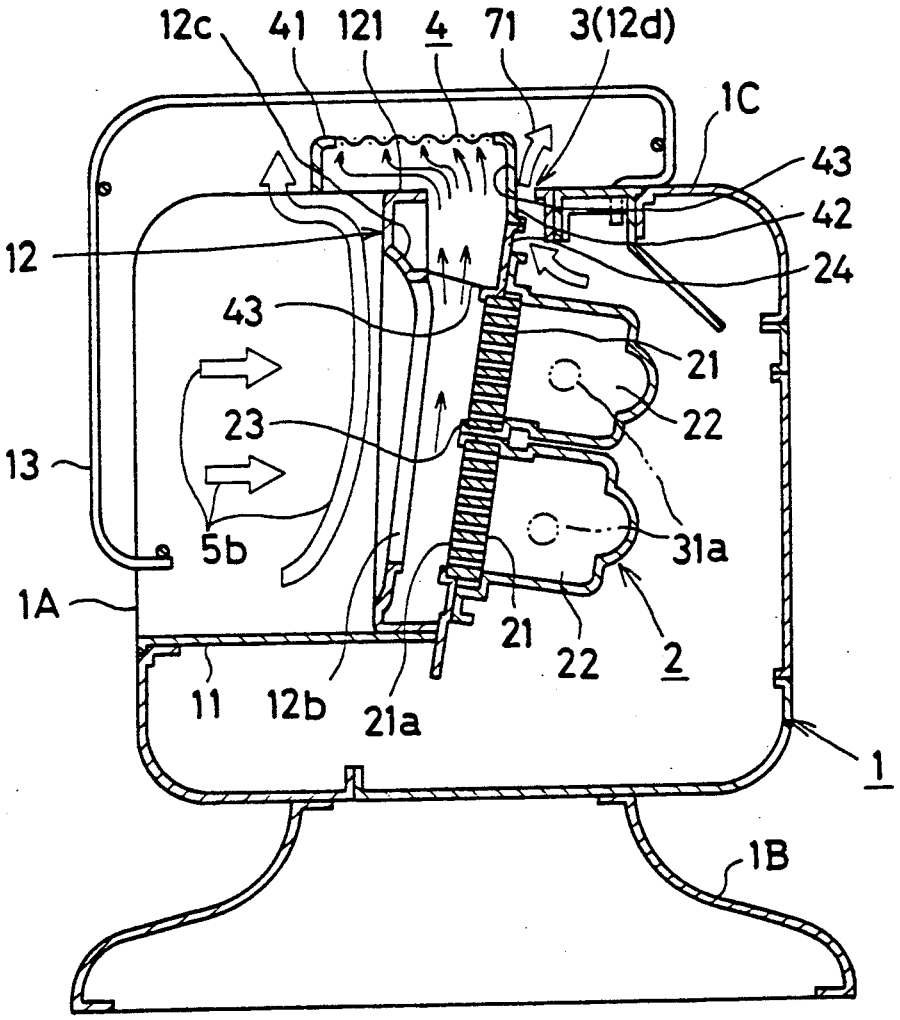
FIG. 7 is a longitudinal cross sectional view taken along the line 7—7 of FIG. 1.
Figure 8:
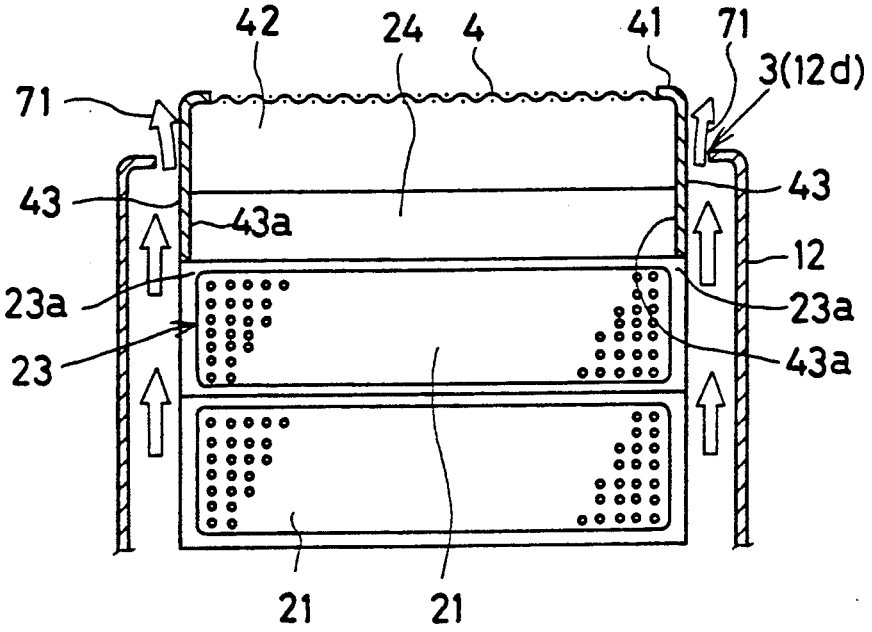
FIG. 8 is a longitudinal cross sectional view of a support frame and an outlet frame to show how convectional air-current is established to prevent excessive temperature rise thereof.

Referring to FIGS. 6 through 8 in which a second embodiment of the invention is shown, like reference numerals identical to those in FIGS. 6 through 8 are those in FIGS. 1 and 2.

In FIGS. 6 and 7, the support frame 12 is enamelled, and an upper lateral side 121 of the support frame 12 has a blank hole to serve as an exhaust opening 3. Between a lower side of the support frame 12 and a lower end of the radiation window 1A, is a radiation plate 11 provided as shown in the first embodiment of the invention. The front open end 12*b* of the support frame 12, which acts as a radiation opening, is turned in to define a barrier flange 12*c* so as to decrease the effective area of the radiation opening 12*b* which works by regulating outside air entry into the support frame 12.

In this instance, the upper lateral side 121 of the support frame 12 is designed to be flush with a top plate 1C of the stove body 1. A rectangular outlet frame 41 is placed on the upper lateral side 121 of the support frame 12, and has a lower extension end 43 generally sectioned in a U-shape which consists of a rear end 42, right and left ends 43*a*. The lower extension end 43 of the outlet frame 41 loosely fits into the exhaust opening 3 to provide an outlet gap 12*d* between an outer wall of the lower extension end 43 and an inner edge of the exhaust opening 3. In this situation, the rear end 42 of the lower extension end 43 is air-tightly connected to an upper end 24 of a sash 23 which is provided to fix an upper portion of the burner plate 21 in place within the stove body 1 as shown in FIG. 3. On the other hand, the right and left ends 43*a* are each extended downwardly to be connected to right and left edges 23*a* of the sash 23 respectively. A front side of the outlet frame 41 is somewhat overhung forward from the upper lateral side 121 of the support frame 12 to increase an opening area of the outlet frame 41.

Within the outlet frame 41, is a metallic net 4 placed to act as an air-permeable member. The metallic net 4 is a steel alloy (JIS SUS 304) of 20-mesh screen, and 0.4 mm in thickness as is the case with the first embodiment of the invention.

In operation, the mixture of fuel gas and air is released from the fire holes of the burner plate 21 is ignited thereon to be burned, and finds a way to escape through the exhaust opening 3 and the outlet frame 41. During this burning process, an appropriate quantity of heat from the burner plate 21 is radiated through the window 1A to warm a room in which the stove body 1 is installed.

As shown in FIG. 8, the outlet gap 12*d* works to positively pass convectional air-current 71 established during the operation so as to prevent the temperature of the frames 41, 12 from being excessively raised.

With the increased fluid-resistance subjected to the exhaust gas passing through the metallic net 4, it is possible to prevent the outside air 5*b* from entering the outlet frame 41 through its overhung portion as shown in FIG. 7.

Figure 9:
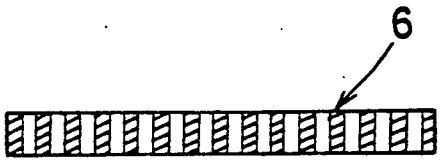
FIG. 9 is a longitudinal cross sectional view a honeycomb-like ceramic plate according to a modified form of the invention.

In FIG. 9, a modified form of the air-permeable member is shown in which a honeycomb-like ceramic plate 6 is employed instead of the metallic net 4. In this instance, when the honeycomb-like ceramic plate 6 is used, it is indicated that the concentration of the nitrogen dioxide is reduced to 6 ppm on average.

It is noted that the thickness and the mesh of the net may be appropriately selected depending on requirements.

It is further appreciated that the metallic net may be in the form of a double-layer screen.

Various changes in the construction and arrangements of the parts may be made without departing from the spirit and scope of the invention as defined in the following claims.

What is claimed is:

1. An infrared stove apparatus comprising:

a stove body having a radiation window at front and upper portions thereof and having a rear wall;

a support frame placed within the stove body between the rear wall and front portion of the stove body and having front and rear open ends and an upper side, the front open end of the frame facing to the front portion of the stove body so as to serve as a radiation opening;

a porous burner plate disposed on the rear open end of the frame, said burner plate having a front side facing, and spaced from, the radiation opening of said frame whereby to define a combustion region;

means for delivering a mixture of fuel gas and air to the rear side of said burner plate, said burner plate being adapted for release therethrough of said mixture of fuel gas and air;

an exhaust opening provided at an upper side of the frame in communication with said combustion region whereby to pass exhaust gas released through the porous burner plate when the mixture of fuel gas and air is ignited at the time of operation; and an air permeable member provided within the exhaust opening to increase fluid resistance of the exhaust gas flowing out through the exhaust opening so as to maintain a substantially uniform velocity distribution of the exhaust gas while restraining outside air from entering into the support frame through the radiation opening leading to the exhaust opening.

2. An infrared stove apparatus according to claim 1, wherein the air-permeable member is a metallic net.

3. An infrared stove apparatus according to claim 2, wherein the metallic net is made from a steel alloy.

4. An infrared stove apparatus according to claim 2, wherein the metallic net is 20-mesh screen, and 0.4 mm in thickness.

5. An infrared stove apparatus according to claim 1, wherein the air-permeable member is a honeycomb-like ceramic plate.

6. An infrared stove apparatus according to claim 1 including a barrier flange along an upper side of the frame adjacent the radiation opening of the frame and below said exhaust opening whereby to limit the entry of outside air into the radiation opening.

7. An infrared stove apparatus comprising:

a stove body having a radiation window at front and upper portions thereof and having a rear wall;

a support frame vertically placed within the stove body between the rear wall and front portion of the stove body and having front and rear open ends and an upper side, the front open end of the support frame facing to the front portion of the stove body so as to serve as a radiation opening;

a porous burner place disposed on the rear open end of the frame, said burner plate having a front side facing, and spaced from, the radiation opening of said frame whereby to define a combustion region;

means for delivering a mixture of fuel gas and air to the rear side of said burner plate, said burner plate being adapted for release therethrough of said mixture of fuel gas and air;

an exhaust opening provided at an upper side of the support frame in communication with said combustion region whereby to pass exhaust gas released through the porous burner plate when the mixture of fuel gas and air is ignited at the time of operation;

an outlet frame placed on the upper side of the support frame, the outlet frame having a lower end which is loosely fit into the exhaust opening to provide an outlet gap therebetween so as to pass convectional air-current through the outlet gap;

a front side of the outlet frame being somewhat overhung forward from the upper side of the support frame so as to enlarge an opening area of the outlet frame; and an air-permeable member provided within the outlet frame to increase the air-flow resistance of the exhaust gas flowing out through the outlet frame so as to maintain a substantially uniform velocity distribution of the exhaust gas while restraining outside air from entering into the support frame through the radiation opening.

8. An infrared stove apparatus according to claim 7, wherein the air-permeable member is a metallic net.

9. An infrared stove apparatus according to claim 7, wherein the metallic net is made from a steel alloy.

10. An infrared stove apparatus according to claim 7, wherein the metallic net is 20-mesh screen, and 0.4 mm in thickness.

11. An infrared stove apparatus according to claim 7, wherein the air-permeable member is a honeycomb-like ceramic plate.

12. An infrared stove apparatus according to claim 7 including a barrier flange along an upper side of the frame adjacent the radiation opening of the frame and below said exhaust opening whereby to limit the entry of outside air into the radiation opening.

13. An infrared stove apparatus comprising:

a stove body having a radiation window at front and upper portions thereof and having a rear wall;

a support frame vertically placed within the stove body between the rear wall and front portion of the stove body and having front and rear open ends and an upper side, the front open end of the support frame facing to the front portion of the stove body so as to serve as a radiation opening;

a porous burner place disposed on the rear open end of the frame, said burner plate having a front side facing, and spaced from, the radiation opening of said frame whereby to define a combustion region;

means for delivering a mixture of fuel gas and air to the rear side of said burner plate, said burner plate being adapted for release therethrough of said mixture of fuel gas and air;

an exhaust opening provided at an upper side of the support frame in communication with said combustion region whereby to pass exhaust gas released through the porous burner plate when the mixture of fuel gas and air is ignited at the time of operation;

an outlet frame placed on the upper side of the support frame, the outlet frame having a lower end which is loosely fit into the exhaust opening to provide an outlet gap therebetween so as to pass convectional air-current through the outlet gap; and an air-permeable member provided with the outlet frame to increase the air-flow resistance of the exhaust gas flowing out through the outlet frame so as to substantially maintain a uniform velocity distribution of the exhaust gas while restraining outside air from entering into the support frame through the radiation opening.

* * * * *